US011877602B2

(12) United States Patent
Lee et al.

(10) Patent No.: US 11,877,602 B2
(45) Date of Patent: Jan. 23, 2024

(54) AEROSOL GENERATING DEVICE AND METHOD OF CONTROL OF THE SAME

(71) Applicant: KT&G CORPORATION, Daejeon (KR)

(72) Inventors: Jae Min Lee, Siheung-si (KR); Hyung Seok Lee, Seoul (KR)

(73) Assignee: KT&G CORPORATION, Daejeon (KR)

( * ) Notice: Subject to any disclaimer, the term of this patent is extended or adjusted under 35 U.S.C. 154(b) by 731 days.

(21) Appl. No.: 16/978,050

(22) PCT Filed: May 8, 2020

(86) PCT No.: PCT/KR2020/006110
§ 371 (c)(1),
(2) Date: Sep. 3, 2020

(87) PCT Pub. No.: WO2020/231106
PCT Pub. Date: Nov. 19, 2020

(65) Prior Publication Data

US 2023/0095659 A1 Mar. 30, 2023

(30) Foreign Application Priority Data

May 16, 2019 (KR) ..... 10-2019-0057601

(51) Int. Cl.
*A24F 40/57* (2020.01)
*A24F 40/51* (2020.01)

(52) U.S. Cl.
CPC ..... *A24F 40/57* (2020.01); *A24F 40/51* (2020.01)

(58) Field of Classification Search
CPC ..... A24F 40/57; A24F 40/51; A24F 40/20; A24F 40/50; A24F 40/46; H05B 1/0227; H05B 1/02
See application file for complete search history.

(56) References Cited

U.S. PATENT DOCUMENTS

| | | | |
|---|---|---|---|
| 9,423,152 | B2 | 8/2016 | Ampolini et al. |
| 10,143,232 | B2 | 12/2018 | Talon |
| 10,159,279 | B2 | 12/2018 | Lord et al. |
| 10,238,143 | B2 | 3/2019 | Capuano |
| 10,645,971 | B2 | 5/2020 | Zitzke |

(Continued)

FOREIGN PATENT DOCUMENTS

| | | | |
|---|---|---|---|
| CA | 3 080 145 | A1 | 10/2018 |
| CN | 106102492 | A | 11/2016 |

(Continued)

OTHER PUBLICATIONS

Communication dated Dec. 7, 2020 by the Korean Patent Office in application No. 10-2019-0057601.

(Continued)

*Primary Examiner* — Truc T Nguyen
(74) *Attorney, Agent, or Firm* — Sughrue Mion, PLLC

(57) ABSTRACT

Provided is an aerosol generating device including a heater configured to heat an aerosol generating material; a sensor configured to detect movement of the aerosol generating device; and a controller configured to: count stop time corresponding to a time for which the movement is not detected during an operation time of the heater, and extend the operation time based on the stop time.

15 Claims, 11 Drawing Sheets

(56) References Cited

U.S. PATENT DOCUMENTS

| | | | | |
|---|---|---|---|---|
| 2011/0036346 | A1 | 2/2011 | Cohen et al. | |
| 2013/0037041 | A1* | 2/2013 | Worm | A24F 40/46 131/329 |
| 2014/0000638 | A1* | 1/2014 | Sebastian | A24F 40/50 131/328 |
| 2014/0270727 | A1* | 9/2014 | Ampolini | A24F 40/50 392/394 |
| 2015/0257445 | A1* | 9/2015 | Henry, Jr. | A24F 40/50 131/328 |
| 2016/0360785 | A1* | 12/2016 | Bless | A24F 40/53 |
| 2017/0150757 | A1* | 6/2017 | Worm | H05B 1/0244 |
| 2017/0202266 | A1* | 7/2017 | Sur | A61M 11/041 |
| 2017/0259170 | A1 | 9/2017 | Bowen et al. | |
| 2018/0160730 | A1* | 6/2018 | Bless | A24F 40/57 |
| 2018/0160734 | A1 | 6/2018 | Batista et al. | |
| 2019/0183177 | A1* | 6/2019 | Hubbard | A61M 15/06 |
| 2019/0247597 | A1 | 8/2019 | Yamada et al. | |
| 2019/0247598 | A1 | 8/2019 | Yamada et al. | |
| 2020/0154772 | A1* | 5/2020 | Lim | A24F 40/51 |

FOREIGN PATENT DOCUMENTS

| | | | |
|---|---|---|---|
| CN | 109349690 | A | 2/2019 |
| CN | 110446435 | A | 11/2019 |
| EP | 2 727 619 | A2 | 5/2014 |
| JP | 2018-520663 | A | 8/2018 |
| JP | 2019-68832 | A | 5/2019 |
| KR | 10-1314895 | B1 | 10/2013 |
| KR | 10-2014-0063506 | A1 | 5/2014 |
| KR | 10-2015-0130458 | A | 11/2015 |
| KR | 10-2016-0058132 | A | 5/2016 |
| KR | 10-1792905 | B1 | 11/2017 |
| KR | 10-2019-0025679 | A | 3/2019 |
| WO | 2007/039794 | A2 | 4/2007 |
| WO | 2018/025380 | A1 | 2/2018 |

OTHER PUBLICATIONS

International Search Report dated Dec. 18, 2020 by the International Searching Authority in application No. PCT/KR2020/006110.

Extended European Search Report dated Nov. 8, 2021 European Application No. 20739836.3.

Office Action dated Apr. 18, 2023, in Chinese Application No. 202080001765.0.

Communication dated Nov. 10, 2023 in European Application No. 20 739 836.3.

* cited by examiner

AEROSOL GENERATING DEVICE AND METHOD OF CONTROL OF THE SAME

TECHNICAL FIELD

One or more embodiments relate to an aerosol generating device, and more particularly, to an aerosol generating device that generates aerosol by heating an aerosol generating material using a heater.

BACKGROUND ART

Recently, the demand for an alternative to traditional cigarettes has increased. For example, there is growing demand for an aerosol generating device that generates aerosol by heating an aerosol generating material, rather than by combusting cigarettes.

In order to prevent fire due to overheating and to secure a preset number of puffs from a given battery capacity, an aerosol generating device may limit an operation time of the heater. However, when the time available for heating the heater is limited, a user may not complete intended smoking within an operation time for various reasons, such as a phone conversation or chatting.

Therefore, in order to prevent heating of the heater from being terminated due to the passage of the operation time when the user has not completed smoking, there is a need for a technique for extending the operation time of the heater.

DISCLOSURE

Technical Solution

One or more embodiments include an aerosol generating device and a method of controlling the same. The technical problem to be achieved by the present disclosure is not limited to the technical problems as described above, and other technical problems may be inferred from the following embodiments.

According to one or more embodiments, an aerosol generating device includes a heater configured to heat an aerosol generating material; a sensor configured to detect movement of the aerosol generating device; and a controller configured to: count stop time during which the movement is not detected during an operation time of the heater, and extend the operation time based on the stop time.

Advantageous Effects

According to an aerosol generating device and a method of controlling the same according to the preset disclosure, the movement of the aerosol generating device may be detected and an operation time may be extended based on the detection. Since the extended time is provided to allow additional puffs, the satisfaction of the user may be improved compared to a case where a power supply to a heater is cut off strictly based on a predetermined operation time.

BEST MODE

Figure 1:
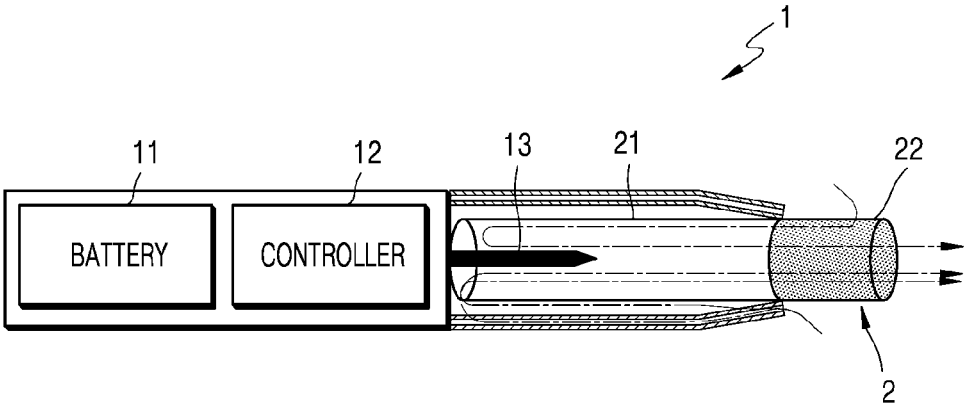
FIGS. 1 through 3 are views illustrating examples in which a cigarette is inserted into an aerosol generating device.

According to one or more embodiments, an aerosol generating device includes: a heater configured to heat an aerosol generating material; a sensor configured to detect movement of the aerosol generating device; and a controller configured to: count stop time corresponding to a time for which the movement is not detected during an operation time of the heater, and extend the operation time based on the stop time.

The controller may extend the operation time by a time obtained by multiplying the stop time by an extension coefficient.

The controller may set the extension coefficient in a range of ⅛ to 1.

The controller may extend the operation time by a time less than or equal to a maximum extension time, and the maximum extension time may be in a range of 30 seconds to 120 seconds.

The controller may discontinuously extend the operation time on the basis of the stop time.

The stop time may be a sum of at least one time period in which the movement is not detected, and the at least one time period may be longer than or equal to a predetermined threshold time.

The predetermined threshold time is a range of 20 seconds to 30 seconds.

The sensor may detect the movement by measuring acceleration of the aerosol generating device.

The operation time may be in a range of 210 seconds to 270 seconds.

According to one or more embodiments, a method of controlling an aerosol generating device includes: controlling power to be supplied to a heater heating an aerosol generating material during an operation time of the heater; counting stop time corresponding to a time for which movement of the aerosol generating device is not detected during the operation time; and extending the operation time based on the stop time.

The extending of the operation time may include extending the operation time by a time obtained by multiplying the stop time by an extension coefficient.

The extending of the operation time may include setting the extension coefficient in a range of ⅛ to 1.

The extending of the operation time may include extending the operation time by a time less than or equal to a maximum extension time, wherein the maximum extension time is a time in a range of 30 seconds to 120 seconds.

The extending of the operation time may include discontinuously extending the operation time on the basis of the stop time.

The stop time may be a sum of at least one time period in which the movement is not detected, and the at least one time period is longer than or equal to a predetermined threshold time.

The threshold time may be in a range of 20 seconds to 30 seconds.

The method may further include sensor may include measuring acceleration of the aerosol generating device; and detecting the movement based on the acceleration.

The operation time may be a time in a range of 210 seconds to 270 seconds.

According to one or more embodiments, a computer-readable recording medium records thereon a program for embodying a method of controlling an aerosol generating device.

MODE FOR INVENTION

Hereinafter, example embodiments will be described in detail with reference to the accompanying drawings. The description of the following embodiments should not be construed as limiting the scope of the embodiments, and it should be construed as belonging to the scope of the embodiments that may be easily inferred by those skilled in the art.

In the embodiments, expressions or terms such as "constituted by," "formed by," "include," "comprise," "including," and "comprising" should not be construed as always including all specified elements, processes, or operations, but may be construed as not including some of the specified elements, processes, or operations, or further including other elements, processes, or operations.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over," "directly above," "directly on," "directly connected to" or "directly coupled to" another element or layer, there are no intervening elements or layers present. Like numerals refer to like elements throughout.

In the embodiments, terms including ordinal numbers such as 'first' or 'second' may be used to describe various components, but the components should not be limited by the terms. The terms are used only for the purpose of distinguishing one component from another.

With respect to the terms used in embodiments of the disclosure, general terms currently and widely used are selected in view of function with respect to the disclosure. However, the terms may vary according to an intention of a technician practicing in the pertinent art, an advent of new technology, etc. In specific cases, terms may be chosen arbitrarily, and in this case, definitions thereof will be described in the description of the corresponding embodiment. Accordingly, the terms used in the embodiments should not necessarily be construed as simple names of the terms, but be defined based on meanings of the terms and overall contents of the present embodiments.

The present embodiments relate to an aerosol generating device and a method of control of the same, and detailed descriptions of the matters well known to one of ordinary skill in the art to which the following embodiments pertain are omitted.

It is assumed that a cigarette is used as an aerosol generating article containing an aerosol generating material in the embodiments described below. However, an aerosol generating material may be provide in any other types of aerosol generating article that may be coupled to an aerosol generating device.

Figure 2:
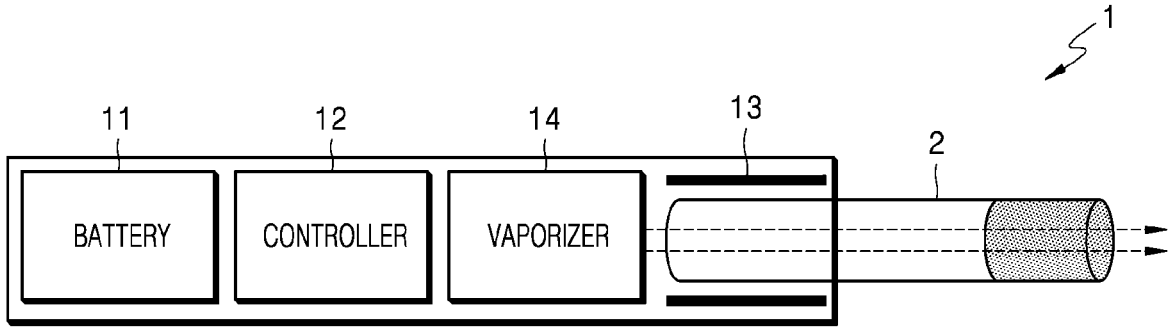
Figure 3:
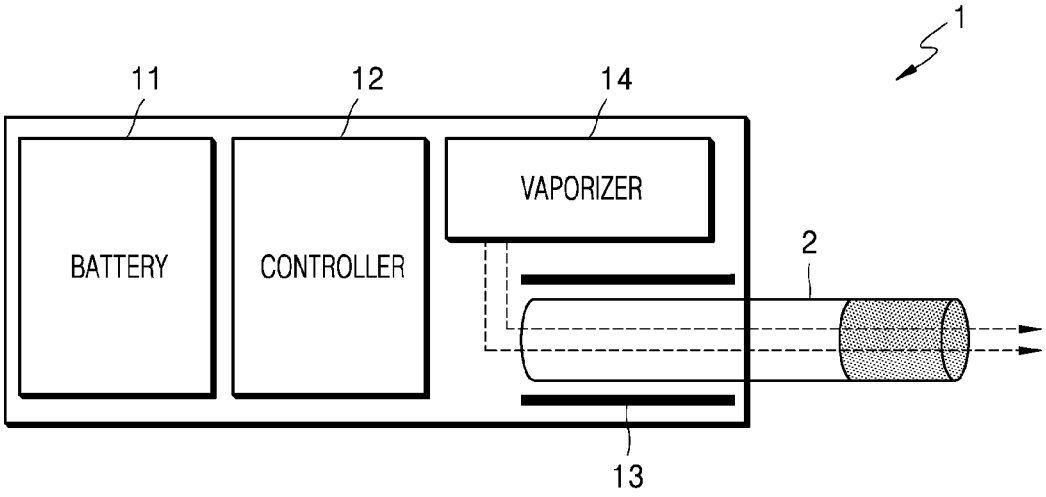

FIGS. 1 through 3 are diagrams showing examples in which a cigarette is inserted into an aerosol generating device.

Referring to FIG. 1, the aerosol generating device 1 may include a battery 11, a controller 12, and a heater 13. Referring to FIGS. 2 and 3, the aerosol generating device 1 may further include a vaporizer 14. Also, the cigarette 2 may be inserted into an inner space of the aerosol generating device 1.

FIGS. 1 through 3 illustrate components of the aerosol generating device 1, which are related to the present embodiment. Therefore, it will be understood by one of ordinary skill in the art related to the present embodiment that other components may be further included in the aerosol generating device 1, in addition to the components illustrated in FIGS. 1 through 3.

Also, FIGS. 2 and 3 illustrate that the aerosol generating device 1 includes the heater 13. However, as necessary, the heater 13 may be omitted.

FIG. 1 illustrates that the battery 11, the controller 12, and the heater 13 are arranged in series. Also, FIG. 2 illustrates that the battery 11, the controller 12, the vaporizer 14, and the heater 13 are arranged in series. Also, FIG. 3 illustrates that the vaporizer 14 and the heater 13 are arranged in parallel. However, the internal structure of the aerosol generating device 1 is not limited to the structures illustrated in FIGS. 1 through 3. In other words, according to the design of the aerosol generating device 1, the battery 11, the controller 12, the heater 13, and the vaporizer 14 may be differently arranged.

When the cigarette 2 is inserted into the aerosol generating device 1, the aerosol generating device 1 may operate the heater 13 and/or the vaporizer 14 to generate an aerosol from the cigarette 2 and/or the vaporizer 14. The aerosol generated by the heater 13 and/or the vaporizer 14 is delivered to a user by passing through the cigarette 2.

As necessary, even when the cigarette 2 is not inserted into the aerosol generating device 1, the aerosol generating device 1 may heat the heater 13.

The battery 11 may supply power to be used for the aerosol generating device 1 to operate. For example, the battery 11 may supply power to heat the heater 13 or the vaporizer 14, and may supply power for operating the controller 12. Also, the battery 11 may supply power for operations of a display, a sensor, a motor, etc. mounted in the aerosol generating device 1.

The controller 12 may generally control operations of the aerosol generating device 1. In detail, the controller 12 may control not only operations of the battery 11, the heater 13, and the vaporizer 14, but also operations of other components included in the aerosol generating device 1. Also, the controller 12 may check a state of each of the components of the aerosol generating device 1 to determine whether or not the aerosol generating device 1 is able to operate.

The controller 12 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heater 13 may be heated by the power supplied from the battery 11. For example, when the cigarette 2 is inserted into the aerosol generating device 1, the heater 13 may be located outside the cigarette 2. Thus, the heated heater 13 may increase a temperature of an aerosol generating material in the cigarette 2.

The heater 13 may include an electro-resistive heater. For example, the heater 13 may include an electrically conductive track, and the heater 13 may be heated when currents flow through the electrically conductive track. However, the heater 13 is not limited to the example described above and may include all heaters which may be heated to a desired temperature. Here, the desired temperature may be pre-set in the aerosol generating device 1 or may be set as a temperature desired by a user.

As another example, the heater 13 may include an induction heater. In detail, the heater 13 may include an electrically conductive coil for heating a cigarette in an induction heating method, and the cigarette may include a susceptor which may be heated by the induction heater.

For example, the heater 13 may include a tube-type heating element, a plate-type heating element, a needle-type heating element, or a rod-type heating element, and may heat the inside or the outside of the cigarette 2, according to the shape of the heating element.

Also, the aerosol generating device 1 may include a plurality of heaters 13. Here, the plurality of heaters 13 may be inserted into the cigarette 2 or may be arranged outside the cigarette 2. Also, some of the plurality of heaters 13 may be inserted into the cigarette 2 and the others may be arranged outside the cigarette 2. In addition, the shape of the heater 13 is not limited to the shapes illustrated in FIGS. 1 through 3 and may include various shapes.

The vaporizer 14 may generate aerosol by heating a liquid composition and the generated aerosol may pass through the cigarette 2 to be delivered to a user. In other words, the aerosol generated via the vaporizer 14 may move along an air flow passage of the aerosol generating device 1 and the air flow passage may be configured such that the aerosol generated via the vaporizer 14 passes through the cigarette 2 to be delivered to the user.

For example, the vaporizer 14 may include a liquid storage, a liquid delivery element, and a heating element, but it is not limited thereto. For example, the liquid storage, the liquid delivery element, and the heating element may be included in the aerosol generating device 1 as independent modules.

The liquid storage may store a liquid composition. For example, the liquid composition may be a liquid including a tobacco-containing material having a volatile tobacco flavor component, or a liquid including a non-tobacco material. The liquid storage may be formed to be detachable from the vaporizer 14 or may be formed integrally with the vaporizer 14.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer 14 may be referred to as a cartomizer or an atomizer, but it is not limited thereto.

The aerosol generating device 1 may further include other components in addition to the battery 11, the controller 12, the heater 13, and the vaporizer 14. For example, the aerosol generating device 1 may include a display capable of outputting visual information and/or a motor for outputting haptic information. Also, the aerosol generating device 1 may include at least one sensor (e.g., a puff detecting sensor, a temperature detecting sensor, a cigarette insertion detecting sensor, etc.). Also, the aerosol generating device 1 may be formed as a structure where, even when the cigarette 2 is inserted into the aerosol generating device 1, external air may be introduced or internal air may be discharged.

Although not illustrated in FIGS. 1 through 3, the aerosol generating device 1 and an additional cradle may form together a system. For example, the cradle may be used to charge the battery 11 of the aerosol generating device 1. Alternatively, the heater 13 may be heated when the cradle and the aerosol generating device 1 are coupled to each other.

The cigarette 2 may be similar to a general combustive cigarette. For example, the cigarette 2 may be divided into a first portion including an aerosol generating material and a second portion including a filter, etc. Alternatively, the second portion of the cigarette 2 may also include an aerosol generating material. For example, an aerosol generating material made in the form of granules or capsules may be inserted into the second portion.

The entire first portion may be inserted into the aerosol generating device 1, and the second portion may be exposed to the outside. Alternatively, only a portion of the first portion may be inserted into the aerosol generating device 1. Otherwise, the entire first portion and a portion of the second portion may be inserted into the aerosol generating device 1. The user may puff aerosol while holding the second portion by the mouth of the user. In this case, the aerosol is generated by the external air passing through the first portion, and the generated aerosol passes through the second portion and is delivered to the user's mouth.

For example, the external air may flow into at least one air passage formed in the aerosol generating device 1. For example, opening and closing of the air passage and/or a size of the air passage may be adjusted by the user. Accordingly, the amount and smoothness of smoke may be adjusted by the user. As another example, the external air may flow into the cigarette 2 through at least one hole formed in a surface of the cigarette 2.

Hereinafter, examples of the cigarette 2 will be described with reference to FIGS. 4 and 5.

Figure 4:
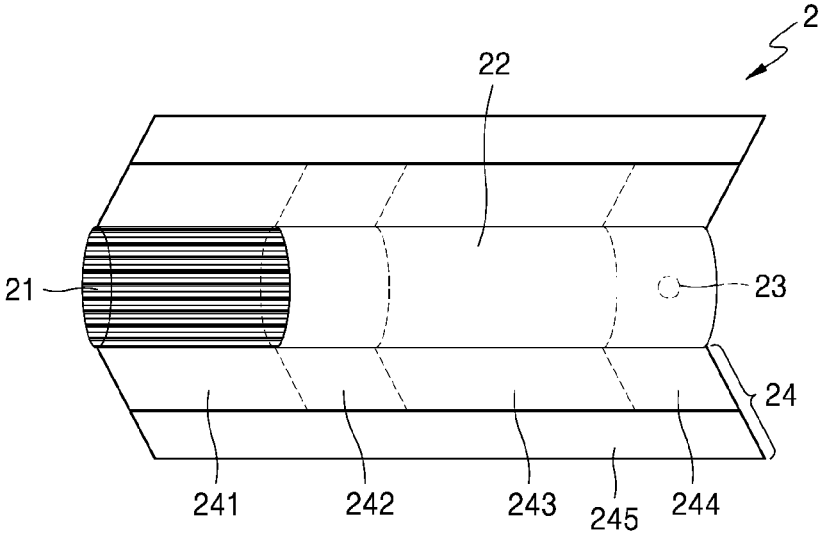
FIGS. 4 and 5 are views illustrating examples of a cigarette.
Figure 5:
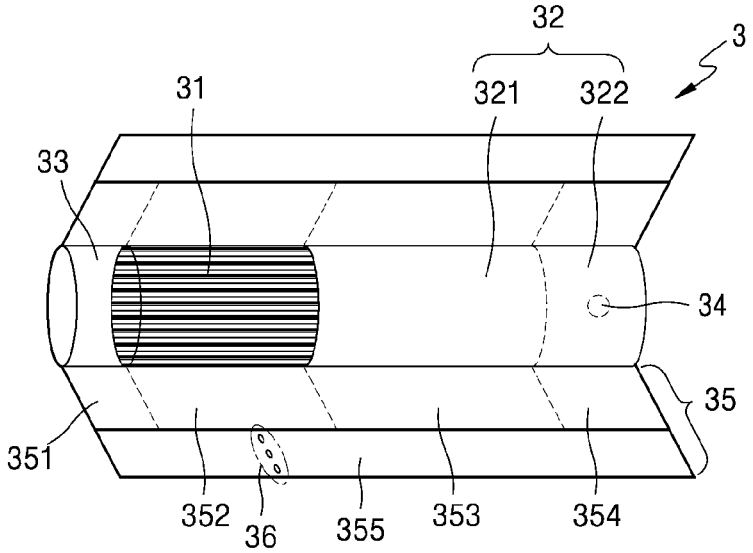

FIGS. 4 and 5 illustrate examples of a cigarette.

Referring to FIG. 4, the cigarette 2 may include a tobacco rod 21 and a filter rod 22. The first portion 21 described above with reference to FIGS. 1 through 3 may include the tobacco rod, and the second portion may include the filter rod 22.

FIG. 4 illustrates that the filter rod 22 includes a single segment. However, the filter rod 22 is not limited thereto. In other words, the filter rod 22 may include a plurality of segments. For example, the filter rod 22 may include a segment configured to cool an aerosol and a segment configured to filter a certain component included in the aerosol. Also, as necessary, the filter rod 22 may further include at least one segment configured to perform other functions.

The cigarette 2 may be packaged using at least one wrapper 24. The wrapper 24 may have at least one hole through which external air may be introduced or internal air may be discharged. For example, the cigarette 2 may be packaged using one wrapper 24. As another example, the cigarette 2 may be doubly packaged using at least two wrappers 24. For example, the tobacco rod 21 may be packaged using a first wrapper, and the filter rod 22 may be packaged using wrappers 242, 243, 244. Also, the entire cigarette 2 may be packaged using a separate wrapper 245. When the filter rod 22 includes a plurality of segments, each segment may be packaged using the wrappers 242, 243, 244.

The tobacco rod 21 may include an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. Also, the tobacco rod 21 may include other additives, such as flavors, a wetting agent, and/or organic acid. Also, the tobacco rod 21 may include a flavored liquid, such as menthol or a moisturizer, which is injected to the tobacco rod 21.

The tobacco rod 21 may be manufactured in various forms. For example, the tobacco rod 21 may be formed as a sheet or a strand. Also, the tobacco rod 21 may be formed as a pipe tobacco, which is formed of tiny bits cut from a tobacco sheet. Also, the tobacco rod 21 may be surrounded by a heat conductive material. For example, the heat conductive material may be, but is not limited to, a metal foil such as aluminum foil. For example, the heat conductive material surrounding the tobacco rod 21 may uniformly distribute heat transmitted to the tobacco rod 21, and thus, the heat conductivity of the tobacco rod may be increased. As a result, the taste of the tobacco may be improved. Also, the heat conductive material surrounding the tobacco rod 21 may function as a susceptor heated by the induction heater. Here, although not illustrated in the drawings, the tobacco rod 21 may further include an additional susceptor, in addition to the heat conductive material surrounding the tobacco rod 21.

The filter rod 22 may include a cellulose acetate filter. Shapes of the filter rod 22 are not limited. For example, the filter rod 22 may include a cylinder-type rod or a tube-type rod having a hollow inside. Also, the filter rod 22 may include a recess-type rod. When the filter rod 22 includes a plurality of segments, at least one of the plurality of segments may have a different shape.

Also, the filter rod 22 may include at least one capsule 23. Here, the capsule 23 may generate a flavor or an aerosol. For example, the capsule 23 may have a configuration in which a liquid containing a flavoring material is wrapped with a film. For example, the capsule 23 may have a spherical or cylindrical shape, but is not limited thereto.

Referring to FIG. 5, the cigarette 3 may further include a front-end filter 33. The front-end filter 33 may be located on a side of the tobacco rod 31, the side not facing the filter rod 32. The front-end filter 33 may prevent the tobacco rod 31 from being detached outwards and prevent the liquefied aerosol from flowing into the aerosol generating device from the tobacco rod 31, during smoking.

The filter rod 32 may include a first segment 321 and a second segment 322. Here, the first segment 321 may correspond to a first segment of the filter rod 22 of FIG. 4, and the second segment 322 may correspond to a third segment of the filter rod 22 of FIG. 4.

A diameter and an entire length of the cigarette 3 may correspond to a diameter and an entire length of the cigarette 2 of FIG. 4. For example, a length of the front-end filter 33 may be about 7 mm, a length of the tobacco rod 31 may be about 15 mm, a length of the first segment 321 may be about 12 mm, and a length of the second segment 322 may be about 14 mm, but are not limited thereto.

The cigarette 3 may be packaged using at least one wrapper 35. The wrapper 35 may have at least one hole through which external air may be introduced or internal air may be discharged. For example, the front-end filter 33 may be packaged using a first wrapper 351, the tobacco rod 21 may be packaged using a second wrapper 352, the first segment 321 may be packaged using a third wrapper 353, and the second segment 322 may be packaged using a fourth wrapper 354. Also, the entire cigarette 3 may be packaged using a fifth wrapper 355.

Also, the fifth wrapper 355 may include at least one perforation 36 formed therein. For example, the perforation 36 may be formed in an area surrounding the tobacco rod 31 but is not limited thereto. The perforation 36 may transfer heat generated by the heater 13 into the tobacco rod 31.

Also, the second segment 322 may include at least one capsule 34. Here, the capsule 34 may generate a flavor and/or aerosol. For example, the capsule 34 may have a configuration in which a liquid containing a flavoring material is wrapped with a film. For example, the capsule 34 may have a spherical or cylindrical shape, but is not limited thereto.

Figure 6:
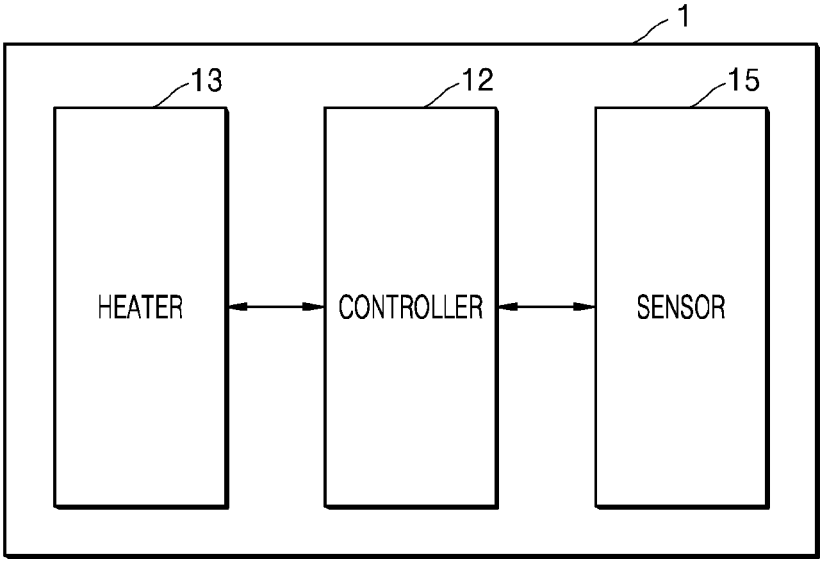
FIG. 6 is a block diagram illustrating elements constituting an aerosol generating device, according to an embodiment.

FIG. 6 is a block diagram illustrating elements constituting an aerosol generating device, according to some embodiments.

Referring to FIG. 6, an aerosol generating device 1 may include a heater 13, a sensor 15, and a controller 12. However, the elements of the aerosol generating device 1 are not limited thereto, and in addition to the elements illustrated in FIG. 6, additional elements may be further included in the aerosol generating device 1. For example, the battery 11 that supplies power to the heater 13 may be further included in the aerosol generating device 1. The descriptions of the aerosol generating device 1, the heater 13, and the controller 12 of FIGS. 1 through 3 may be equally applied to the aerosol generating device 1, the heater 13, and the controller 12 of FIG. 6.

The sensor 15 may be an element for detecting movement of the aerosol generating device 1. The sensor 15 may output a value representing the movement of the aerosol generating device 1, and the controller 12 may detect the movement of the aerosol generating device 1 by using the value output by the sensor 15.

The sensor 15 may include an acceleration sensor that measures acceleration of the aerosol generating device 1. The acceleration of the aerosol generating device 1 may be measured by the acceleration sensor, and the controller 12 may detect the movement of the aerosol generating device 1 on the basis of the acceleration of the aerosol generating device 1 measured by the acceleration sensor. For example, the controller 12 may determine that a movement is absent when the acceleration of the aerosol generating device 1 is less than a particular value and may determine that a movement is present when the acceleration of the aerosol generating device 1 is greater than or equal to the particular value.

The sensor 15 may be arranged in various positions in the aerosol generating device 1. For example, when the sensor 15 includes the acceleration sensor, and the acceleration sensor is used to detect a tab operation of a user, the acceleration sensor may be arranged near a position where the tab operation of the user is performed.

The controller 12 may control power to be supplied to the heater 13 during an operation time. To prevent fire due to overheating and secure a preset number of puffs from a given battery capacity, the controller 12 may limit the operation time of the heater. Therefore, when the operation time expires, the power supplied to the heater 13 may be cut off, and thus, heating of the heater 13 may not be performed.

The operation time may be preset and stored in the aerosol generating device 1. The operation time may be set in consideration of the number of times the aerosol generating device 1 may be used when the battery 11 is fully charged. For example, the operation time may be set in the range of 210 seconds to 270 seconds. Alternatively, the operation time may be set to 240 seconds.

The controller 12 may count stop time corresponding to a time for which the movement of the aerosol generating device 1 is not detected, during the operation time of the heater 13. When the movement of the aerosol generating device 1 is not detected, it may be determined that a puff of the user has not occurred. Therefore, the controller 12 may count the stop time to determine how long the puff of the user is absent.

The controller 12 may extend the operation time on the basis of the stop time. Since the puff of the user is not performed at least during the stop time, it is likely that an additional puff of the user may follow. Therefore, to prevent the power supply to the heater 13 from being interrupted due to the passage of the operation time, the controller 12 may extend the operation time on the basis of the stop time.

Figure 7:
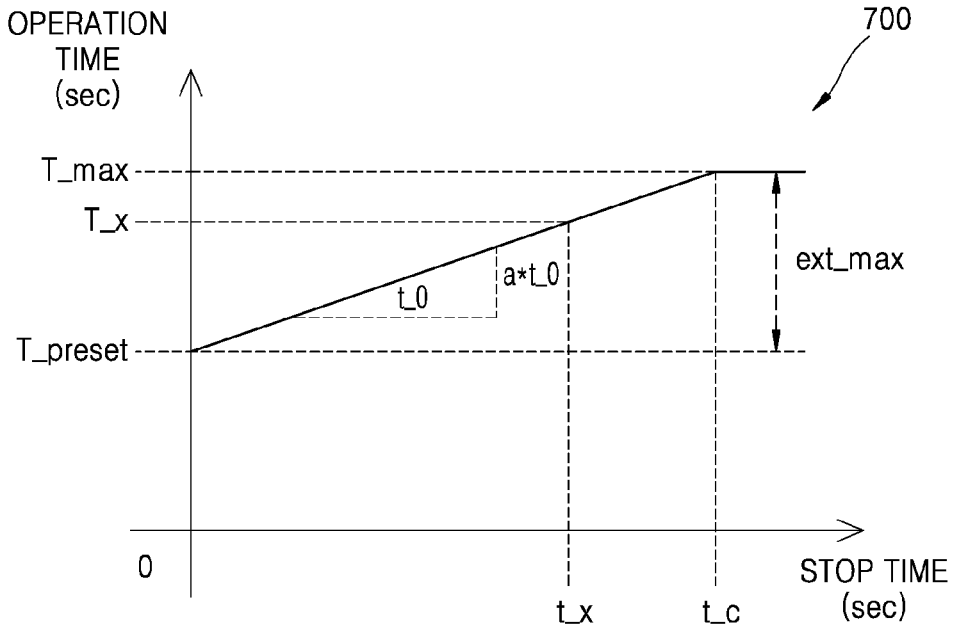
FIG. 7 is a view illustrating a graph for explaining a process of extending an operation time on the basis of stop time, according to an embodiment.

FIG. 7 is a view illustrating a graph for explaining a process of extending an operation time on the basis of stop time, according to an embodiment.

Referring to FIG. 7, a graph 700 shows that an operation time extends as stop time increases. When there is no stop time counted, i.e., the stop time is 0, an operation time may be a preset time T_preset. As described above with reference to FIG. 6, for example, the preset time T_preset may be in a range of 210 seconds to 270 seconds.

The controller 12 may extend the operation time by a time obtained by multiplying the stop time by an extension coefficient. Referring to the graph 700, in a section before a reference time t_c, the operation time may linearly increase as the stop time increases. A relationship between an increase amount of the stop time and an increase amount of the operation time may be expressed by an extension coefficient a. When the stop time increases by t_0, the operation time may increase by a*t_0. In other words, in the section before the reference time t_c, a slope of a straight line may be equal to a. In the section before the reference time t_c, an operation time T_x for a random stop time t_x may be expressed as in Equation 1 below.

$$T_x = T_\text{preset} + (a \cdot t_x) \quad (1)$$

The controller 12 may extend the operation time by a time less than or equal to a maximum extension time. Referring to the graph 700, when the stop time is the reference time t_c, the operation time may extend to a maximum operation time T_max. In other words, the operation time may be extended by a maximum extension time ext_max added to the preset time T_preset.

Since the increment in the operation time may not exceed the maximum extension time ext_max, the operation time may be maintained in an appropriate range. Since the increase in the operation time may be limited, power consumed to maintain a temperature of the heater 13 during the operation time may be limited to an appropriate range, thereby reducing wasted power and increasing energy efficiency.

The maximum extension time ext_max may be set differently according to embodiments. In an embodiment, the maximum extension time ext_max may be set in consideration of the preset time T_preset. For example, the maximum extension time ext_max may be a value corresponding to ⅛ to ½ of the preset time T_preset. Thus, if the preset time T_preset is 240 seconds, the maximum extension time ext_max may be in a range of 30 seconds to 120 seconds. However, the maximum extension time ext_max is not limited thereto and may be set to other appropriate values on the basis of various factors in addition to the preset time T_preset.

The extension coefficient a may also set differently according to embodiments. The controller 12 may set the extension coefficient a within a range that satisfies predetermined conditions. The extension coefficient a may be set to a value less than or equal to 1. As such, the operation time may be prevented from extending by a value greater than the stop time (i.e., a total of one or more time periods during which the movement of the aerosol generating device 1 is not detected).

The extension coefficient a may be set in consideration of the maximum extension time ext_max. For example, when the entire preset time T_preset corresponding is the stop time, the controller 12 may set the value of the extension coefficient a such that the operation time extends by the maximum extension time ext_max. For example, if the stop time is 240 seconds and the maximum extension time ext_max is 30 seconds, the extension coefficient a may be set to be greater than or equal to ⅛. If the stop time is 240 seconds and the maximum extension time ext_max is 120 seconds, the extension coefficient a may be set to be greater than or equal to ½.

However, the extension coefficient a is not limited thereto, and the controller 12 may set the extension coefficient a to other appropriate values that may convert the stop time into the operation time such that the extended operation time does not exceed the maximum operation time T_max.

Figure 8:
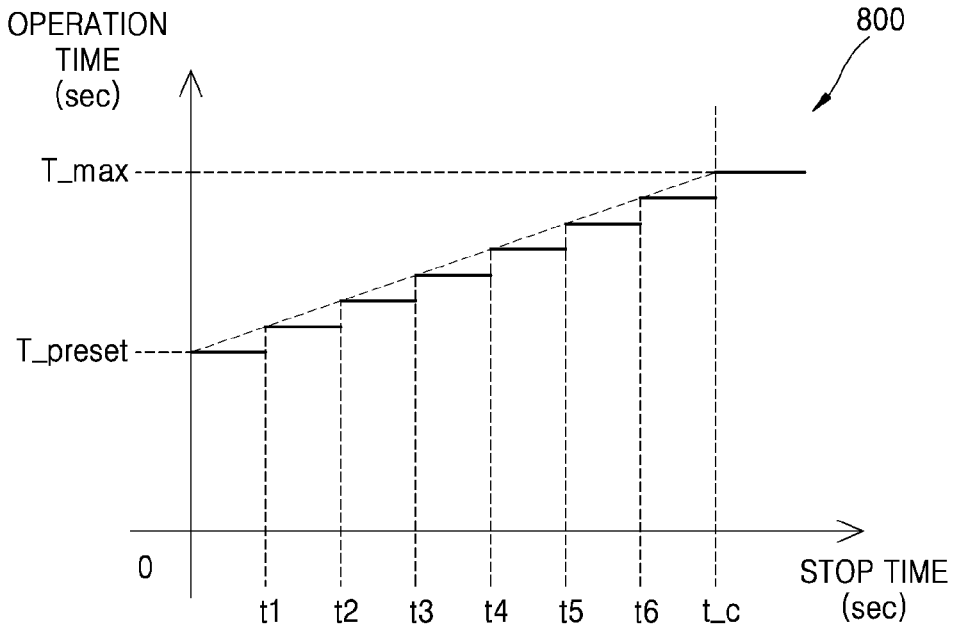
FIG. 8 illustrates a process of discontinuously extending an operation time, according to an embodiment.

FIG. 8 is a graph illustrating a process of discontinuously extending an operation time, according to an embodiment.

Referring to FIG. 8, an operation time is discontinuously extended as stop time increases. Except that an operation time discontinuously extends in a section before a reference time t_c, the description of the graph 700 of FIG. 7 may be equally applied to the graph 800.

The controller 12 may discontinuously extend the operation time on the basis of stop time. Referring to the graph 800, the controller 12 may divide the section before the reference time t_c into a plurality of sections by using time points t1 . . . t6 as boundaries. The controller 12 may discontinuously extend the operation time by allowing the operation time to have a different constant value in each section.

When the operation time discontinuously extends, a computation process performed by the controller 12 may be simplified. While an effect of extending the operation time on the basis of the stop time is maintained, processing efficiency of the controller 12 may be improved, and thus, a structure of the controller 12 may be more simplified and power consumption may be reduced.

Figure 9:
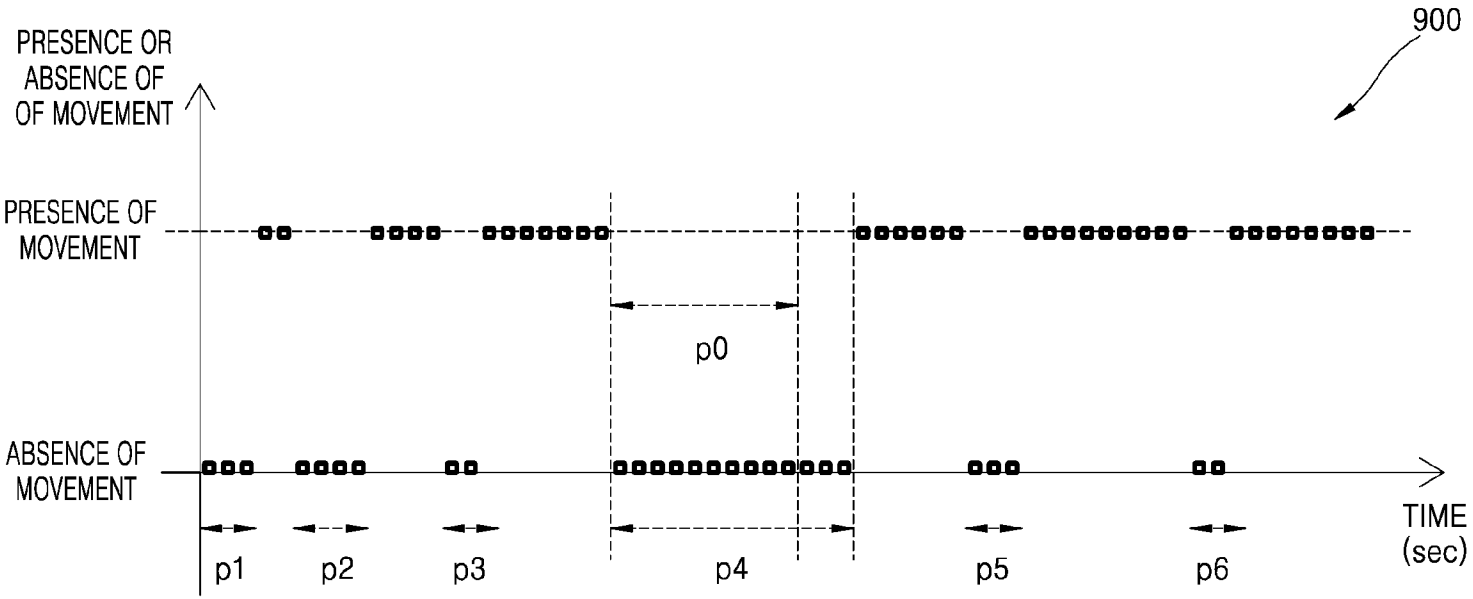
FIG. 9 illustrates a process of counting stop time on the basis of a threshold time, according to an embodiment.

FIG. 9 is a view illustrating a process of counting stop time, according to some embodiments.

Referring to FIG. 9, a graph 900 shows when a movement of the aerosol generating device 1 is detected by the sensor 15 is illustrated. Along a horizontal axis of the graph 900, time periods during which the movement of the aerosol generating device 1 is not detected is indicated by as a plurality of time sections p1 . . . p6.

The controller 12 may not count a time period less than a threshold time as the stop time. In other words, the controller 12 may only count a time period greater than or equal to the threshold time as the stop time. Referring to the graph 900, the threshold time may be represented as in a reference section p0.

For each of the plurality of time sections p1 . . . p6, the controller 12 may count a time section greater than or equal to the threshold time. In the graph 900, since only the time section p4 is longer than the reference section p0 (i.e., the threshold time), only the time section p4 may be counted as the stop time.

The controller 12 may count, as a stop time, a sum of certain time periods greater than or equal to the threshold time among all the time periods during which the movement is not detected. In the case of the graph 900, the controller 12 may count the duration of the time section p4 as the stop time. However, if there is another time section (e.g., p7) longer than the reference section p0, the controller 12 may also count the time section p7 as stop time. In this case, the stop time is a sum of the time sections p4 and p7.

The controller 12 may count the stop time by using the threshold time in a different way. For example, the controller 12 may count, as stop time, only a difference between the threshold time and a time section longer than or equal to the threshold time. In the case of the graph 900, the controller 12 may count, as stop time, the remaining time period of p4 after subtracting the reference section p0 from the time section p4.

The threshold time may be set to various values that enable the stop time to be appropriately counted. For example, the controller 12 may set the threshold time in a range of 15 seconds to 40 seconds. Alternatively, the controller 12 may set the threshold time in a range of 20 seconds to 30 seconds.

As the stop time is counted on the basis of the threshold value, the stop time during which the movement of the aerosol generating device 1 is not detected may be more accurately counted. In particular, as the threshold time is used, an excessive amount of time may be prevented from being counted as the stop time. Thus, the operation time may be prevented from overly extending.

Figure 10:
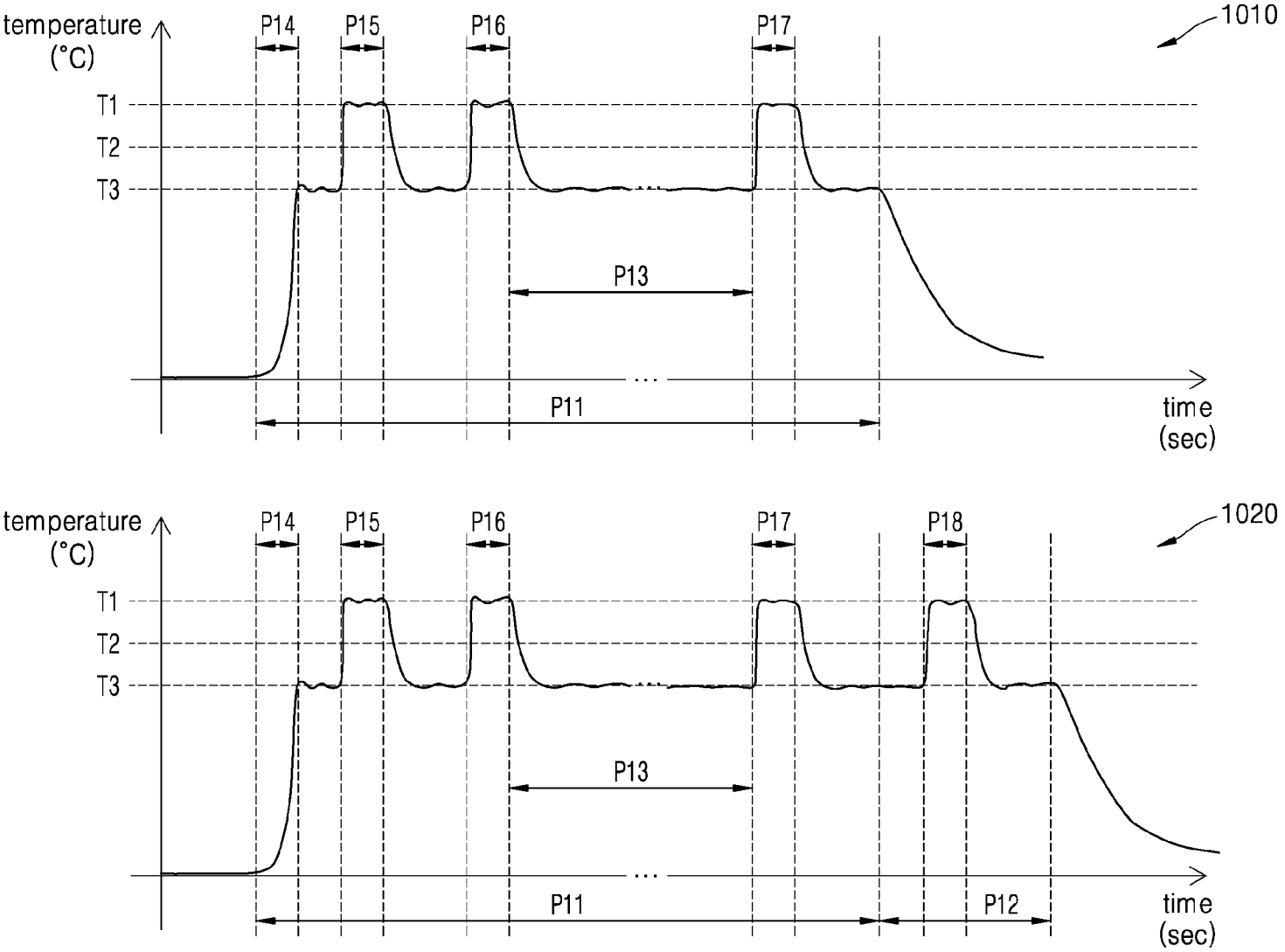
FIG. 10 illustrates an effect of extending an operation time, according to an embodiment.

FIG. 10 illustrates an effect of extending an operation time, according to an embodiment.

Referring to FIG. 10, a graph 1010 shows changes in a temperature of the heater 13 when an operation time does not extend. On the other hand, a graph 1020 shows changes in the temperature of the heater 13 when the operation time extends on the basis of the stop time according to an embodiment.

Referring to the graph 1010, the controller 12 may control power to be supplied to the heater 13 during an operation time p11. Therefore, when the operation time p11 passes, the power supply to the heater 13 may be cut off. In a preheating section p14, a temperature of the heater 13 may be preheated to an atmospheric temperature T3. The atmospheric temperature T3 may be a temperature lower than a vaporization temperature T2 of an aerosol generating material.

During the operation time p11, a plurality of puffs may be performed. Puff sections p14 . . . p17 may refer to time sections in which puffs are respectively performed. In each puff section, the temperature of the heater 13 may be maintained at a puff temperature T1. The puff temperature T1 may be a temperature higher than the vaporization temperature T2.

As shown in the graph 1010, the operation time p11 includes stop time p13 during which a movement of the aerosol generating device 1 is not detected. Since a puff is not performed during the stop time p13, a user may want an additional puff. However, if the power supply to the heater 13 is cut off due to the passage of the operation time p11 as shown in the graph 1010, the additional puff may not be allowed.

Referring to the graph 1020, the controller 12 may count the stop time p13 and extend an operation time by an extension time p12 on the basis of the stop time p13. Since at least a part of the stop time p13 is compensated for by the extension time p12, the user may perform an additional puff during a puff time p18, and thus, the satisfaction of the user may be improved.

Figure 11:
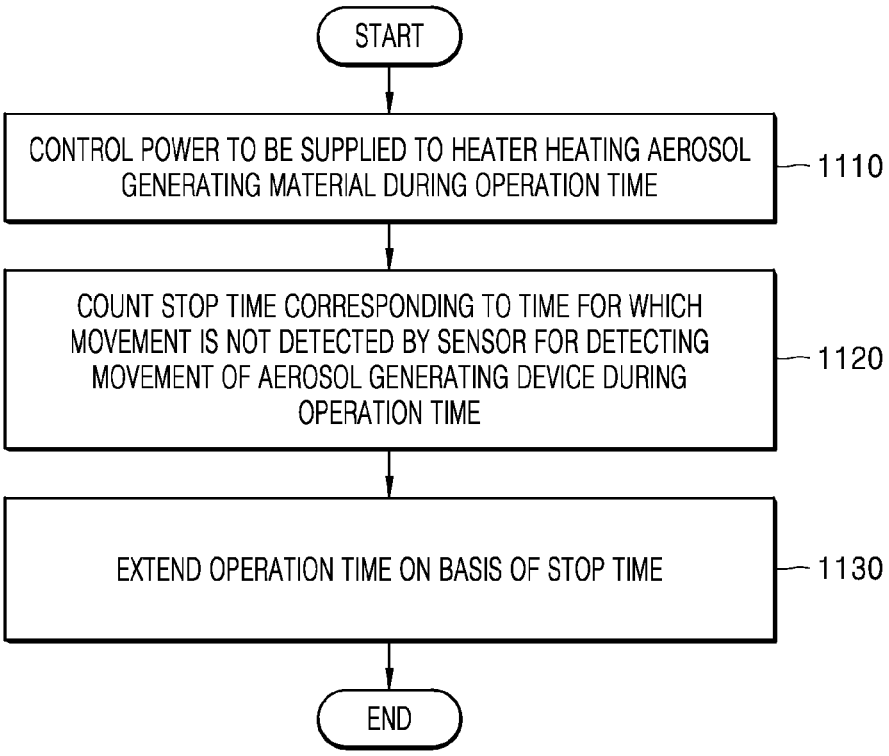
FIG. 11 is a flowchart illustrating a method of controlling an aerosol generating device, according to an embodiment.

FIG. 11 is a flowchart illustrating a method of controlling an aerosol generating device, according to an embodiment.

Referring to FIG. 11, a method of controlling the aerosol generating device 1 may include operations 1110 through 1130. However, the method is not limited thereto, and in addition to the operations illustrated in FIG. 11, other general-purpose operations may be further included in the method of FIG. 11 of controlling the aerosol generating device 1.

The method of FIG. 11 of controlling the aerosol generating device 1 may apply to the aerosol generating device 1 of FIGS. 1 through 10. Therefore, although the descriptions of the method of FIG. 11 are omitted below, the above descriptions of the aerosol generating device 1 of FIGS. 1 through 10 may be equally applied to the method of claim 11.

In operation 1110, the aerosol generating device 1 may control power to be supplied to a heater that heats an aerosol generating material during an operation time.

The operation time may be in a range of 210 seconds to 270 seconds.

In operation 1120, the aerosol generating device 1 may count stop time that is a sum of time periods during which a movement of the aerosol generating device 1 is not detected by the sensor 15 during the operation time.

The aerosol generating device 1 may not count a time period less than a threshold time as the stop time. In other words, the aerosol generating device 1 may only count a time period greater than or equal to the threshold time as the stop time.

The aerosol generating device 1 may set the threshold time in a range of 20 seconds to 30 seconds.

The sensor 15 may include an acceleration sensor that measures acceleration of the aerosol generating device 1, and the aerosol generating device 1 may count the stop time by detecting the movement on the basis of the acceleration.

In operation 1130, the aerosol generating device 1 may extend the operation time on the basis of the stop time.

The aerosol generating device 1 may extend the operation time by a time obtained by multiplying the stop time by an extension coefficient.

The aerosol generating device 1 may set the extension coefficient in a range of ⅛ to 1.

The aerosol generating device 1 may discontinuously extend the operation time by a time less than or equal to a maximum extension time, and the maximum extension time may be in a range of 30 seconds to 120 seconds.

The aerosol generating device 1 may discontinuously extend the operation time on the basis of the stop time.

The method of controlling the aerosol generating device 1 shown in FIG. 11 may be recorded on a computer-readable recording medium recording thereon one or more programs including instructions executing the method.

Examples of computer-readable recording media may include magnetic media such as hard disks, floppy disks, and magnetic tapes, optical media such as CD-ROM and DVD, magneto-optical media such as floptical disks, and hardware devices particularly configured to store and perform program instructions, such as ROM, RAM, and flash memory. Examples of program instructions may include high-level language coded that may be executed by a computer using an interpreter and the like as well as machine language codes made by a compiler.

At least one of the components, elements, modules or units (collectively "components" in this paragraph) represented by a block in the drawings, such as the controller 12 in FIG. 6, may be embodied as various numbers of hardware, software and/or firmware structures that execute respective functions described above, according to an example embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above example embodiments may be implemented in algorithms that execute on one or more processors. Furthermore, the components represented by a block or processing steps may employ any number of related art techniques for electronics configuration, signal processing and/or control, data processing and the like.

Although the embodiments have been described in detail above, the scope of the present disclosure is not limited thereto, and various modifications improvements of those skilled in the art using the basic concept of the present disclosure as defined in the following claims also belong to the scope of the present disclosure.

What is claimed is:

1. An aerosol generating device comprising:
a heater configured to heat an aerosol generating material;
a sensor configured to detect movement of the aerosol generating device; and
a controller configured to:
count stop time corresponding to a time for which the movement is not detected during an operation time of the heater, and
extend the operation time based on the stop time.

2. The aerosol generating device of claim 1, wherein the controller extends the operation time by a time obtained by multiplying the stop time by an extension coefficient.

3. The aerosol generating device of claim 1, wherein
the controller extends the operation time by a time less than or equal to a maximum extension time, and
the maximum extension time is in a range of 30 seconds to 120 seconds.

4. The aerosol generating device of claim 1, wherein the controller discontinuously extends the operation time based on the stop time.

5. The aerosol generating device of claim 1, wherein
the stop time is a sum of at least one time period in which the movement is not detected, and
the at least one time period is longer than or equal to a predetermined threshold time.

6. The aerosol generating device of claim 5, wherein the predetermined threshold time is a range of 20 seconds to 30 seconds. device.

7. The aerosol generating device of claim 1, wherein
the sensor detects the movement by measuring acceleration of the aerosol generating device.

8. The aerosol generating device of claim 1, wherein the operation time is in a range of 210 seconds to 270 seconds.

9. A method of controlling an aerosol generating device, the method comprising:
controlling power to be supplied to a heater heating an aerosol generating material during an operation time of the heater;
counting stop time corresponding to a time for which movement of the aerosol generating device is not detected during the operation time; and
extending the operation time based on the stop time.

10. The method of claim 9, wherein the extending of the operation time includes extending the operation time by a time obtained by multiplying the stop time by an extension coefficient.

11. The method of claim 9, wherein the extending of the operation time includes extending the operation time by a time less than or equal to a maximum extension time, and
wherein the maximum extension time is in a range of 30 seconds to 120 seconds.

12. The method of claim 9, wherein the extending of the operation time includes discontinuously extending the operation time based on the stop time.

13. The method of claim 9, wherein
the stop time is a sum of at least one time period in which the movement is not detected, and
the at least one time period is longer than or equal to a predetermined threshold time.

14. The method of claim 13, wherein the predetermined threshold time is in a range of 20 seconds to 30 seconds.

15. The method of claim 9, further comprising:

measuring acceleration of the aerosol generating device; and detecting the movement based on the acceleration.

* * * * *